US006253955B1

(12) United States Patent
Bower

(10) Patent No.: US 6,253,955 B1
(45) Date of Patent: Jul. 3, 2001

(54) VENDING MACHINE

(75) Inventor: James Bower, Windsor (AU)

(73) Assignee: Airgate Sourcing and Supply PTY LTD, Windsor (AU)

( * ) Notice: Subject to any disclaimer, the term of this patent is extended or adjusted under 35 U.S.C. 154(b) by 0 days.

(21) Appl. No.: 09/486,958

(22) PCT Filed: Aug. 26, 1998

(86) PCT No.: PCT/AU98/00694

§ 371 Date: Mar. 3, 2000

§ 102(e) Date: Mar. 3, 2000

(87) PCT Pub. No.: WO99/12132

PCT Pub. Date: Mar. 11, 1999

(30) Foreign Application Priority Data

Sep. 3, 1997 (AU) ..... PP3197

(51) Int. Cl.[7] ..... G07F 11/72
(52) U.S. Cl. ..... 221/150 R; 221/211
(58) Field of Search ..... 221/150 R, 210, 221/211

(56) References Cited

U.S. PATENT DOCUMENTS 4,232,798 * 11/1980 Hammel et al. ..... 221/12
4,721,197 * 1/1988 Hoffman ..... 221/210 X
4,848,592 * 7/1989 Shemeta ..... 221/211
5,240,139 * 8/1993 Chirnomas ..... 221/150 R X

FOREIGN PATENT DOCUMENTS

2455973 * 6/1975 (DE) .
2455673 * 5/1976 (DE) ..... 221/211
WO97/04427 * 2/1997 (WO) .

* cited by examiner

*Primary Examiner*—David H. Bollinger
(74) *Attorney, Agent, or Firm*—Abelman, Frayne & Schwab

(57) ABSTRACT

A vending machine (10) including a cabinet (12) having therein a storage compartment (21) and product extraction means (20) including a base (29) operatively connected to the cabinet for pivoting about vertical axis (27), first link means (25*a*) horizontally pivoted to the base, second link means (25*b*) horizontally pivoted to the other end of the first link, actuator for respectively pivoting the base, first link and second link, and coupling means operatively connected (through guide head (33)) to the other end of the second link means (25*b*) for coupling with a selected product in the storage compartment (21) for delivery to a product station, the extraction means (20) being controlled by control means (15) after product selection by a customer.

30 Claims, 6 Drawing Sheets

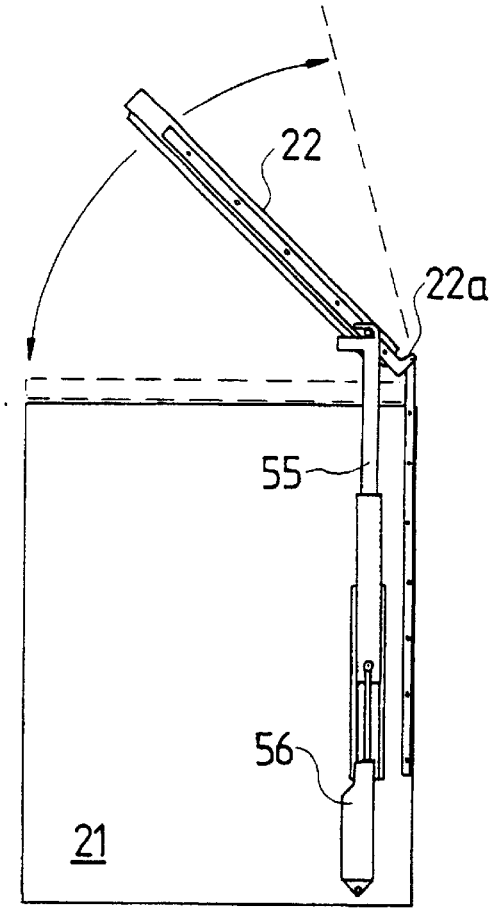
FIG. 3
FIG. 4
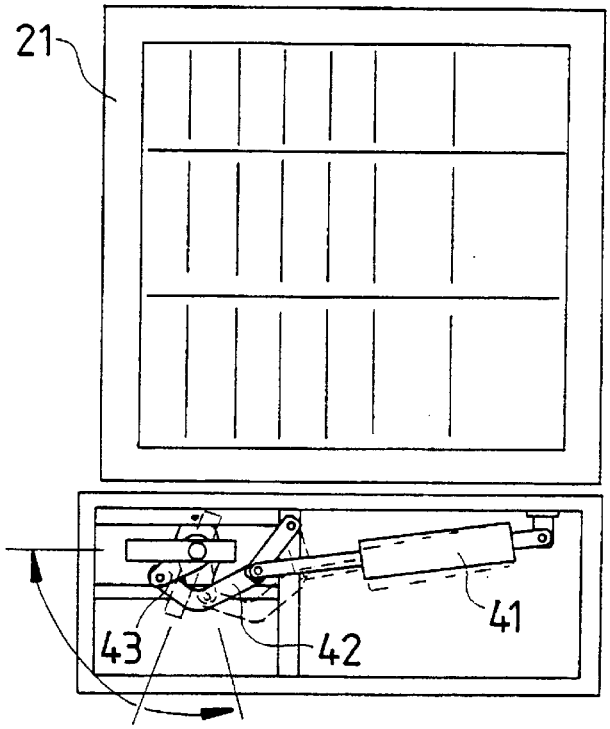
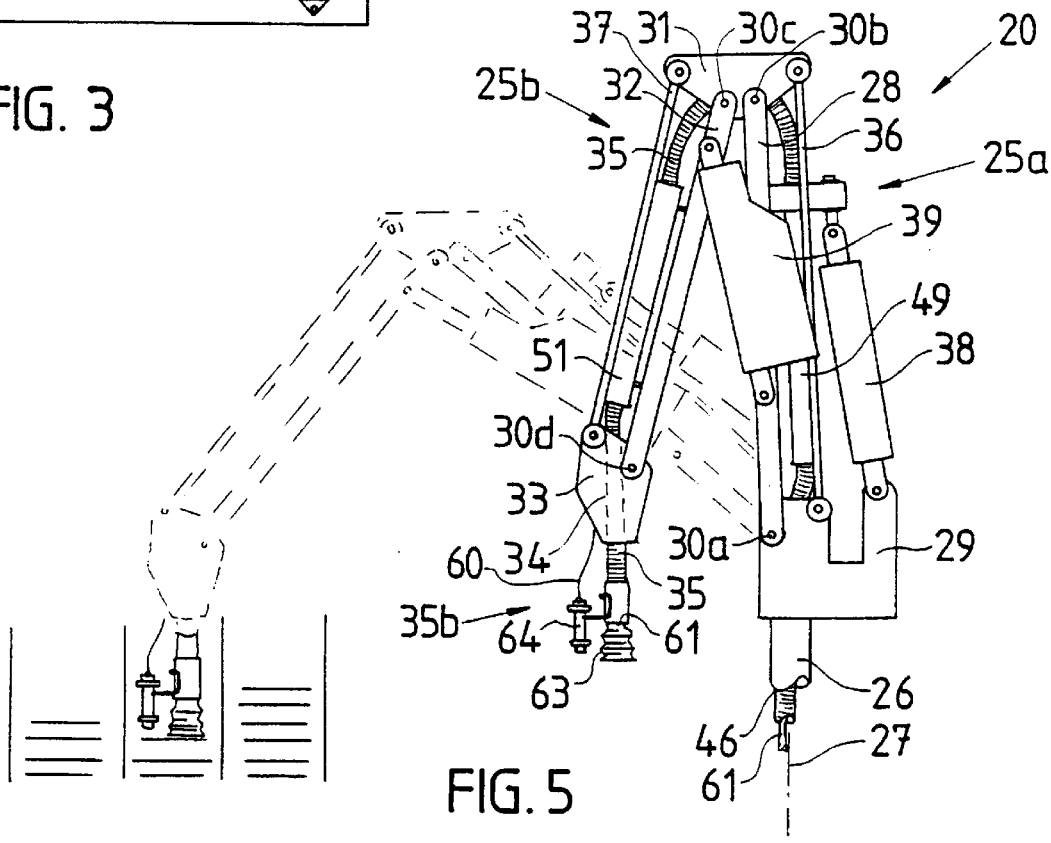
FIG. 5

VENDING MACHINE

TECHNICAL FIELD OF THE INVENTION

This invention relates to vending machines.

The invention has particular application to vending machines for vending chilled or frozen products especially in pre-packaged form. However, it will be appreciated that the invention may also be used with other vendible products.

BACKGROUND ART

The presently available vending machines for vending frozen products fall into two main types. The first type has a cabinet containing a plurality of racks each normally arranged to contain one product line and having a pusher or the like for dispensing a product from the rack upon selection of the desired product by a customer. In some cases, instead of using a pusher each rack may be an auger which rotates to move a product held therein into a delivery chute. This general type of machine is illustrated in U.S. Pat. No. 5,025,950 to Trouteaud et al. It will be appreciated that in this type of machine, the number of products held in each rack is fairly small and the product line is limited to a fairly specific size and shape to suit the rack. Furthermore, each rack requires an undesirably large space in order for the dispensing mechanisms to work effectively and the racks themselves must be contained in the freezer compartment which therefor must be undesirably large.

A second known type of vending machine includes a freezer cabinet which houses an extraction device arranged to extract a desired product from the freezer upon selection by a customer and dispense it via a dispensing chute. In such apparatus the extraction device typically includes a beam crane or gantry crane movable to any selected x, y co-ordinates within the cabinet whereupon a suction device supported by the crane moves down into a product compartment at the selected co-ordinates and attaches itself by suction to a product and then lifts it clear of the product compartment then the crane moves to a position above a dispensing chute and releases the selected product which slides down the chute for collection by the customer. In this type of machine the beam crane is typically moved by motor driven (closed loop) cables or rack and pinion devices. A variation on this type of vending machine is disclosed in U.S. Pat. No. 5,240,139 which describes a machine in which a beam crane is movable to any selected x, y co-ordinate above a chest freezer and also includes a mechanism for opening the door of the chest freezer so that a selected product can be extracted and then allows the door to close after the product has been extracted. It will be appreciated that in this machine, the extraction mechanism is housed outside the chest freezer and is not subject to the hostile environment of the other types mentioned and furthermore, the chest freezer can be almost fully allocated to product storage.

It is an object of the present invention to provide a vending machine which has at least some of the advantages proffered by the use of a chest freezer in a vending machine and to provide additional advantages arising from the use of a different extraction device.

DISCLOSURE OF THE INVENTION

With the foregoing in view, this invention in one aspect resides broadly in a vending machine including:

a cabinet;

a storage compartment in said cabinet for storing products to be vended, said storage compartment having an upwardly directed access opening;

product extraction means in said cabinet for extracting products from said storage compartment and a customer accessible product station for receiving products extracted by said product extraction means;

selection means on a customer accessible position of said cabinet for selecting a product to be extracted;

control means in operative communication with said product extraction means for controlling the operation of said product extraction means in response to a product selection;

said product extraction means including a base member operatively connected to said cabinet or mounted in said cabinet for pivoting movement relative thereto about a vertical axis and first elongate link means operatively connected at one end to said base member for pivoting movement relative thereto about a first horizontal axis and second elongate link means operatively connected at one end to the other end of said first elongate link means for movement relative to said first elongate link means about a second horizontal axis, first actuation means operatively connected to said first elongate link means and said base member for pivotally moving said first elongate link means about said first horizontal axis, second actuation means operatively connected to said first and second elongate link means for pivotally moving said second elongate link means relative to said first elongate link means above said access opening about said second horizontal axis, third actuation means operatively connected to said base member for pivotally moving said base member about said vertical axis, and coupling means operatively connected to the other end of said second elongate link means for coupling with a selected product wherein it may be extracted from said storage compartment.

In another aspect the invention resides broadly in a vending machine including:

a cabinet;

a refrigerated storage compartment in said cabinet for storing chilled or frozen food products, said storage compartment having an upwardly directed access opening and a compartment closure for closing said upwardly directed access opening;

product extraction means in said cabinet for extracting chilled or frozen food products from said storage compartment and a customer accessible product station for receiving products extracted by said product extraction means;

opening means operatively connected to said compartment closure for selectively opening said closure to allow said product extraction means access to food products in said refrigerated storage compartment;

selection means on a customer accessible position of said cabinet for selecting a product to be extracted;

control means in operative communication with said product extraction means for controlling the operation of said product extraction means and said opening means in response to a product selection;

said product extraction means including a base member operatively connected to said cabinet or mounted in said cabinet for pivoting movement relative thereto about a vertical axis and first elongate link means operatively connected at one end to said base member for pivoting movement relative thereto about a first horizontal axis and second elongate link means operatively connected at one end to the other end of said first elongate link means for movement relative to said first elongate link means about a second horizontal axis, first actuation means operatively connected to said first elongate link means and said base member for pivotally moving said first elongate link means about said first horizontal axis, second actuation means operatively connected to said first and second elongate link means for pivotally moving said second elongate link means relative to said first elongate link means above said access opening about said second horizontal axis, third actuation means operatively connected to said base member for pivotally moving said base member about said vertical axis, and coupling means operatively connected to the other end of said second elongate link means for coupling with a selected food product wherein it may be extracted from said storage compartment.

Preferably, said product extraction means is mounted on a stand in said cabinet and said third actuation means is operatively connected to said stand and said base member so as to move said base member relative to said stand.

Preferably, the vending machine includes fourth actuation means operatively connected to said coupling means for moving said coupling means up and down with respect to said second link means so that said coupling means may couple with products located at any depth within the storage compartment. It is also preferred that said coupling means include a flexible and resilient coupling head adapted to abut a surface of the selected product in such manner that vacuum pressure provided at said coupling head may cause the product to be "sucked" on to the coupling head thus being securely engaged, the vacuum being provided by a vacuum pump or other source of vacuum operatively connected to said coupling head by a tubular member such as a vacuum tube or hose connected to said coupling head at one end and at the other end to the vacuum pump. Preferably, such vacuum pump or other source has a low flow rate and provides a relatively high negative pressure vacuum, for example, 6 cubic metres per hour at −80 kPa. Advantageously, such high negative pressure is believed to decrease the possibility of product slippage sideways and resultant dropping of the product whilst being extracted. In such form of the invention, the vacuum pump is remote from the first and second link means and the tubular member is attached in such manner to allow up and down movement of said tubular member in conjunction with said coupling means. In a preferred form said tubular member is supported by a semi-rigid sheath which connects said coupling means to said fourth actuation means and preferably the sheath is a helical spring which is guided for linear movement along or beside said first and second link means by rollers mounted thereon whilst in another embodiment the spring passes through a tubular sleeve. Suitably, the spring has sufficient flexibility to allow bending so as to accommodate pivoting movement of said first and second link means but is sufficiently rigid for linear movement therealong or therebeside. It is also preferred that said fourth actuation means be a short stroke linear actuator connected to said spring via a crank adapted to cause movement of the spring so that the coupling means can be lowered from a first position above the storage compartment to a second position on or close top the bottom of the storage compartment. For this purpose it is preferred that the spring have sufficient flexibility to bend through an arc of about 90 degrees at a radius of about 500 mm to 800 mm.

Preferably, said control means is arranged to control said first and second actuators for movement in unison so that the height of said distal second end relative to said access opening is maintained substantially constant. It will be appreciated that in such case the height of the coupling means will be varied for coupling with the selected food product. It is also preferred that said control means include sensing means for sensing contact with or proximity to a product to be extracted or other suitable parameter whereby coupling may be effected. In one form of the invention, said sensing means is a proximity switch mounted on or adjacent said coupling means for sensing the position of the coupling means relative to a selected product whereby downward movement of the coupling head can be stopped upon said coupling head reaching a position at a predetermined distance from the product and vacuum may be applied to said coupling means to effect coupling and upward movement may be commenced once coupling has been effected or after a predetermined period. In another embodiment, said sensing means includes a contact member operatively connected to said coupling means and adapted for progressive displacement upon contact with the product to be extracted and a micro-switch arranged to sense a predetermined amount of displacement of said contact member.

In yet another aspect the invention resides broadly in a vending machine including:

a cabinet;

a refrigerated storage compartment in said cabinet for storing chilled or frozen food products, said storage compartment having an upwardly directed access opening and a compartment closure for closing said upwardly directed access opening;

product extraction means in said cabinet for extracting chilled or frozen food products from said storage compartment and a customer accessible product station for receiving products extracted by said product extraction means;

opening means operatively connected to said compartment closure for selectively opening said closure to allow said product extraction means access to food products in said refrigerated storage compartment;

selection means on a customer accessible position of said cabinet for selecting a product to be extracted;

control means in operative communication with said product extraction means for controlling the operation of said product extraction means and said opening means in response to a product selection;

transfer means for receiving extracted food products from said product extraction means and transferring said products to said product station, said transfer means including a chute and guide means for guiding a product to be transferred into said chute, said guide means being movable in response to a product selection from a stowed position remote from said storage compartment to a guiding position adjacent said storage compartment upon opening of said compartment closure;

said product extraction means including a base member operatively connected to said cabinet or mounted in said cabinet for pivoting movement relative thereto about a vertical axis and first elongate link means operatively connected at one end to said base member for pivoting movement relative thereto about a first horizontal axis and second elongate link means operatively connected at one end to the other end of said first elongate link means for movement relative to said first elongate link means about a second horizontal axis, first actuation means operatively connected to said first elongate link means and said base member for pivotally moving said first elongate link means about said first horizontal axis, second actuation means operatively connected to said first and second elongate link means for pivotally moving said second elongate link means relative to said first elongate link means above said access opening about said second horizontal axis, third actuation means operatively connected to said base member for pivotally moving said base member about said vertical axis, and coupling means operatively connected to the other end of said second elongate link means for coupling with a selected food product wherein it may be extracted from said storage compartment and delivered to said transfer means.

BRIEF DESCRIPTION OF THE DRAWINGS

In order that the invention may be more readily understood and put into practical effect, reference will now be made to the accompanying drawings which illustrate preferred embodiments of the invention and wherein:

FIG. 3 is a side elevation of the chest freezer in the vending machine cabinet as shown in FIG. 2 illustrating the operation of the freezer lid;

FIG. 4 is a plan view of the vending machine of FIG. 1 with the top wall and side walls of the cabinet all removed and with the freezer lid removed;

FIG. 5 illustrates the operation of the product extractions unit for extracting products from the chest freezer of the vending machine of FIG. 1, and FIGS. 6 and 7 are pictorial representations of an alternative coupling head and sensor arrangement for the vending machine of FIG. 1;

DETAILED DESCRIPTION OF THE DRAWINGS

Figure 1:
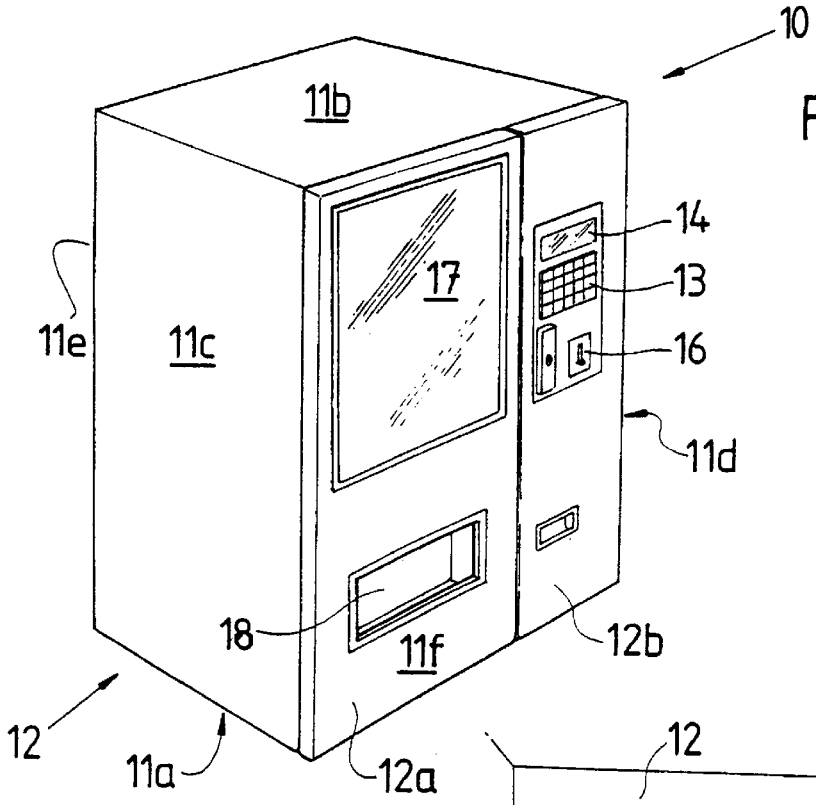
FIG. 1 is a pictorial representation of a vending machine according to the present invention.
Figure 2:
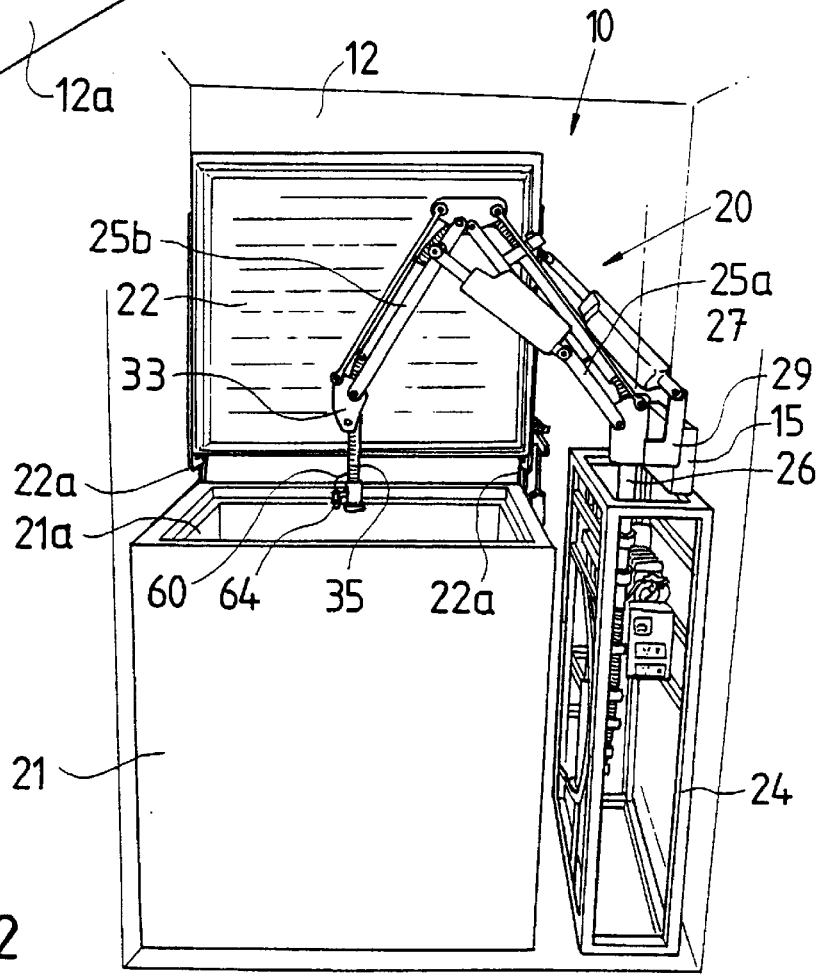
FIG. 2 is a pictorial representation of the vending machine of FIG. 1 from the front with the front panel of the vending machine cabinet removed.

The vending machine 10 illustrated in FIG. 1 has an outer cabinet 11 having a base wall 11*a,* a top wall 11*b,* two spaced apart side walls 11*c* and 11*d,* a rear wall 11*e* and a removablefront wall 11*f* having an outer frame and two side by side hingedly mounted doors 12*a* and 12*b* which allow access to the interior of the cabinet for maintenance and restocking. A product selection panel 13 is mounted on the front door of the cabinet in the normal manner for operation by a customer for selecting a desired product and an electronically operated message display unit 14 is located above the selection panel. Similarly a coin mechanism 16 and associated coin retrieval chute are mounted in the front door in the usual manner.

A glass window 17 is also provided in the front door and extends across a large part of the upper portion of the cabinet whereby a customer may view the extraction and dispensing of the selected product which can be collected from the delivery station provided in the lower part of the door 12*a*.

A chest freezer 21 having a food storage compartment 21*a* stands in the outer cabinet for storage of frozen food products, particulary ice creams and ice blocks which are typically stacked in plastic or cardboard containers opening upwardly towards the lid 22. The lid is pivotally mounted at its rear edge by two spaced apart hinge assemblies 22*a* for opening upwardly towards the rear wall of the cabinet 12 so that the food products can be accessed from the top of the freezer. Advantageously, the hinge assemblies are constructed to allow the lid to open within the plan area of the freezer so that the maximum width freezer can be accommodated in a preselected size cabinet.

A product extraction unit 20 for extracting products from the freezer and delivering them to the delivery station via delivery chute 19 is mounted to a stand 24 in the cabinet 12 which in turn is secured to the base wall of the cabinet adjacent one side of the freezer. The product extraction unit includes a base 29 and a first parallel linkage arm assembly 25*a* connected at one end to the base and a second parallel linkage arm assembly 25*b* connected to the other end of the first arm assembly. The two arm assemblies operate in unison as will be more fully described later. A shaft 26 depends from the base 29 and is supported in bearings mounted to the stand for pivotal movement about a vertical axis 27 adjacent the side wall of the chest freezer, the base being secured to the shaft for pivoting movement therewith. The first parallel linkage arm assembly includes a first arm member 28 which is pivotally connected at one end to the base 29 by a horizontally disposed pivot pin 30*a* for up and down pivoting movement and at the other end to a connector member 31 by a horizontally disposed pivot pin 30*b*. A second arm member 32 is also pivotally connected to the connector member by a horizontally disposed pivot pin 30*c* for allowing up and down pivoting movement of the second arm member relative to the connector member. At its other end the second arm member 32 is pivotally connected to a guide head 33 by a horizontally disposed pin 30*d,* the guide head having a passage 34 for slidably receiving a extraction tube 35 therethrough for up and down movement into and out of the freezer compartment as will be explained more fully later. The orientation of the guide head such that the passage 34 is substantially vertical is maintained by first and second link members 36 and 37 which are pivotally connected to the base, connector member and guide head respectively in parallel with the respective first and second arm members.

Movement of the first and second arm members is effected by first and second linear actuators 38 and 39 respectively, the first linear actuator being pivotally connected to the base 29 and the first arm member whilst the second linear actuator is pivotally connected to the first arm member and the second arm member in such manner that as the respective linear actuators extend in unison the first arm member pivots relative to the base 29 and connector member 31 and the second arm member pivots relative to the connector member and the guide head so that the two arm members are extended to place the guide head 33 at a desired position above the chest freezer with the height of the guide head being maintained substantially constant.

Pivoting of the base 29 about the axis 27 is effected by a third actuator 41 which is pivotally connected at one end to the shaft via a crank assembly having a crank arm 43 extending radially from the shaft and an intermediate link arm 42 as will be more clearly understood from FIG. 4.

Movement of the guide head 33 relative to the freezer is controlled by an electronic controller 15 mounted on the stand 24 which causes the first, second, and third actuators to position the guide head above a particular product according to preprogrammed coordinates in response to a product selection made by a customer operating selection panel 13 after the appropriate payment has been made via coin mechanism 16. The position of the guide head is determined by the distance each actuator has extended from a predetermined datum and the preset coordinates are selected according to a particular extension of each actuator. The amount of extension is determined by the inclusion of signal pulse generators attached to the respective actuators and one or more pulses are generated upon one revolution of the actuator motor depending on the degree of accuracy required for positioning of the guide head.

Figure 11:
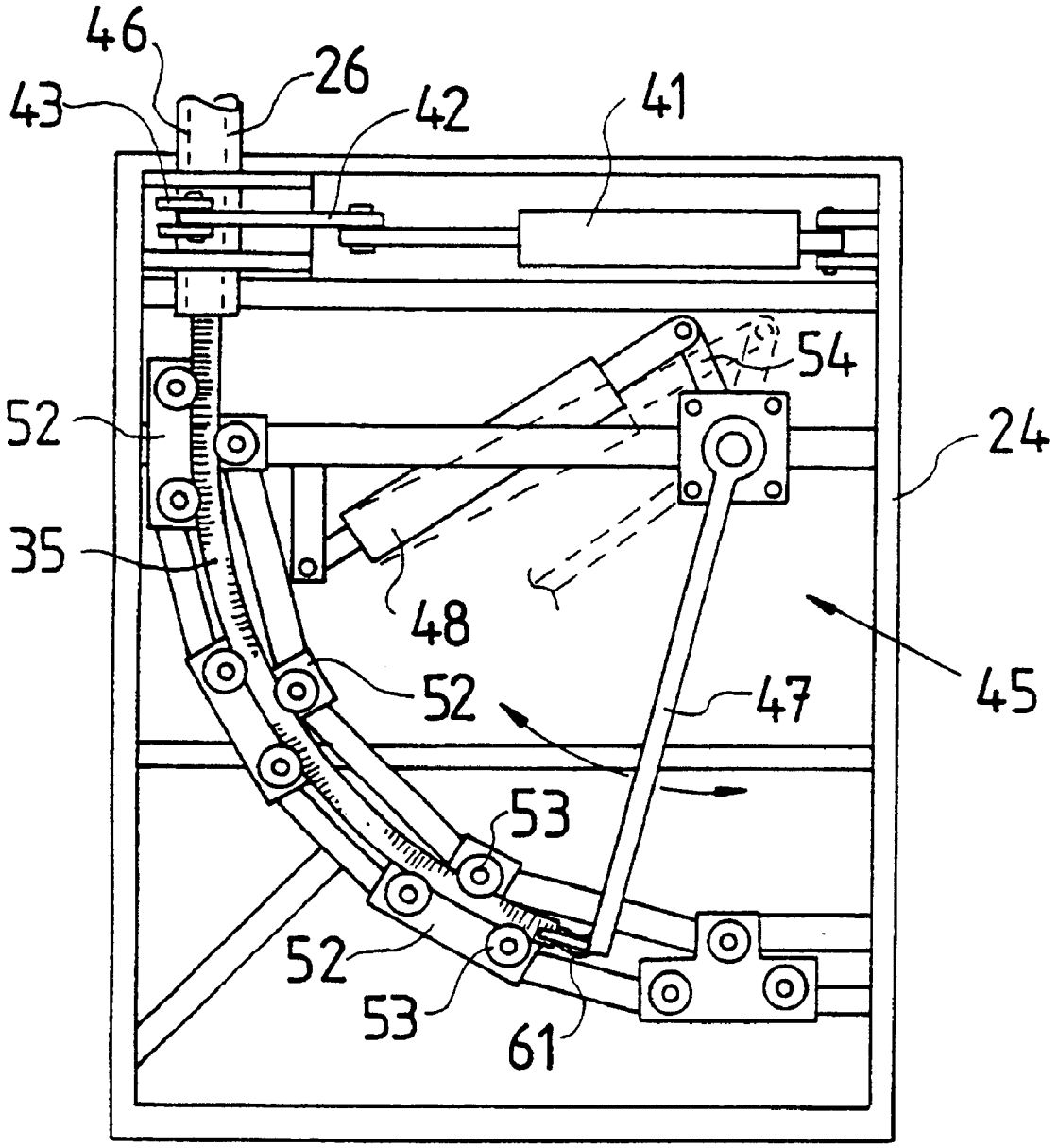
FIG. 11 is a side elevation of the mounting frame assembly on which the product extraction unit is mounted in the machine of FIG. 1.
Figure 12:
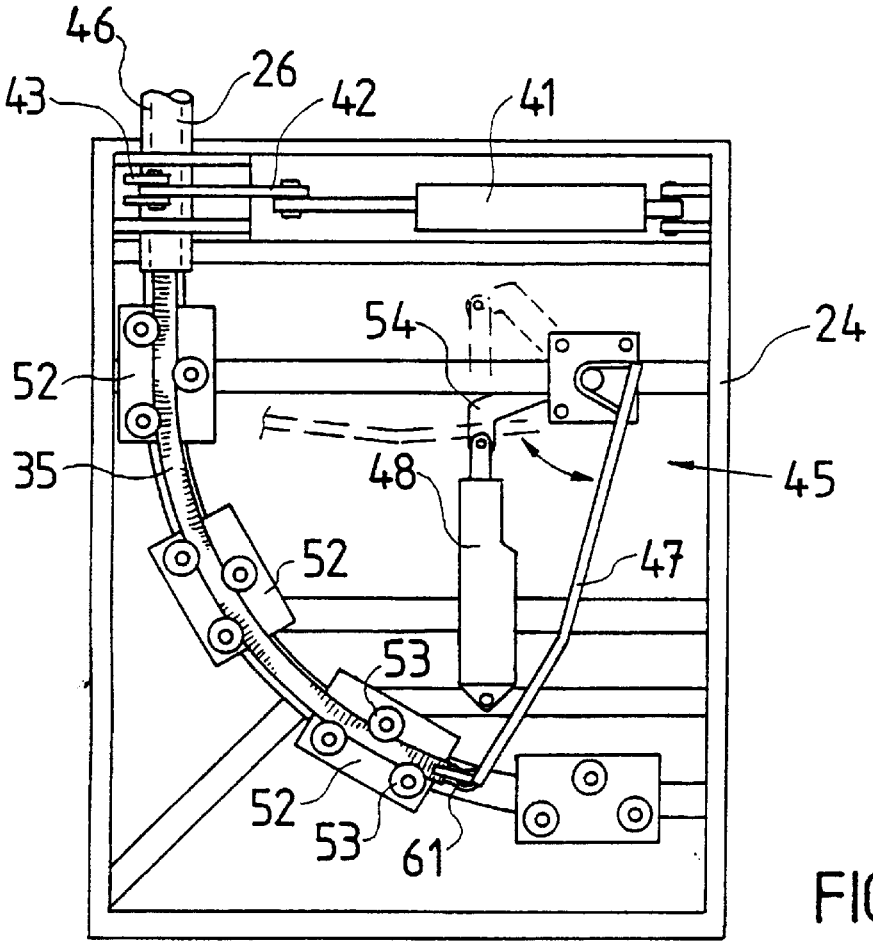
FIG. 12 is a side elevation of the mounting frame assembly on which the product extraction unit is mounted in the machine of FIG. 1 but showing an alternative arrangement for supporting the extraction tube.
Figure 13:
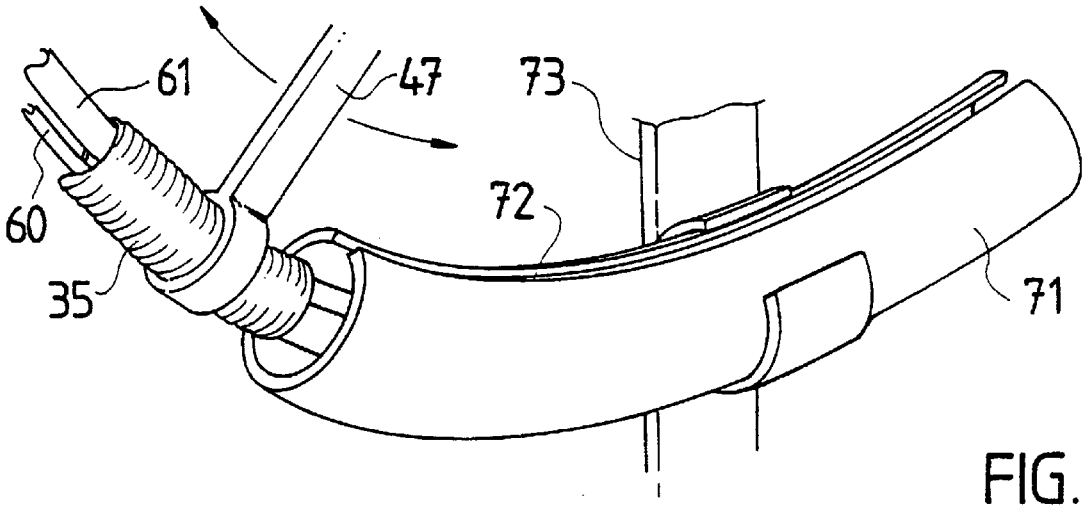
FIG. 13 is a pictorial representation of another alternative arrangement for supporting the extraction tube of the vending machine of FIG. 1.
Figure 14A:
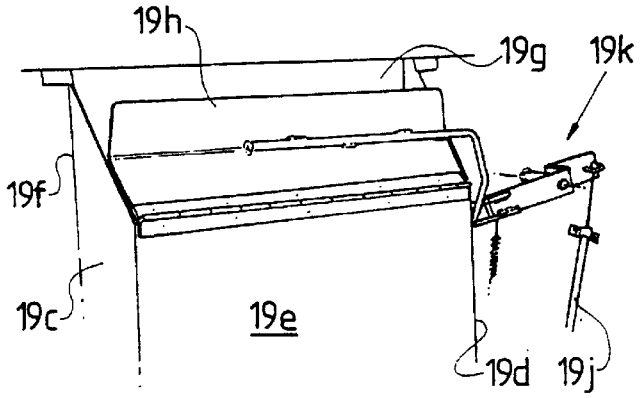
FIGS. 14*a* and 14*b* are pictorial representations of the transfer chute of the vending machine of FIG. 1, with guide door in open and closed attitudes respectively.
Figure 14B:
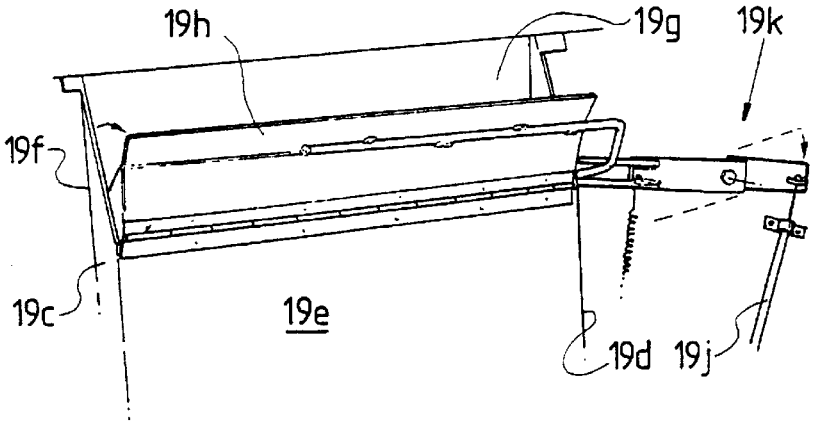
Figure 15:
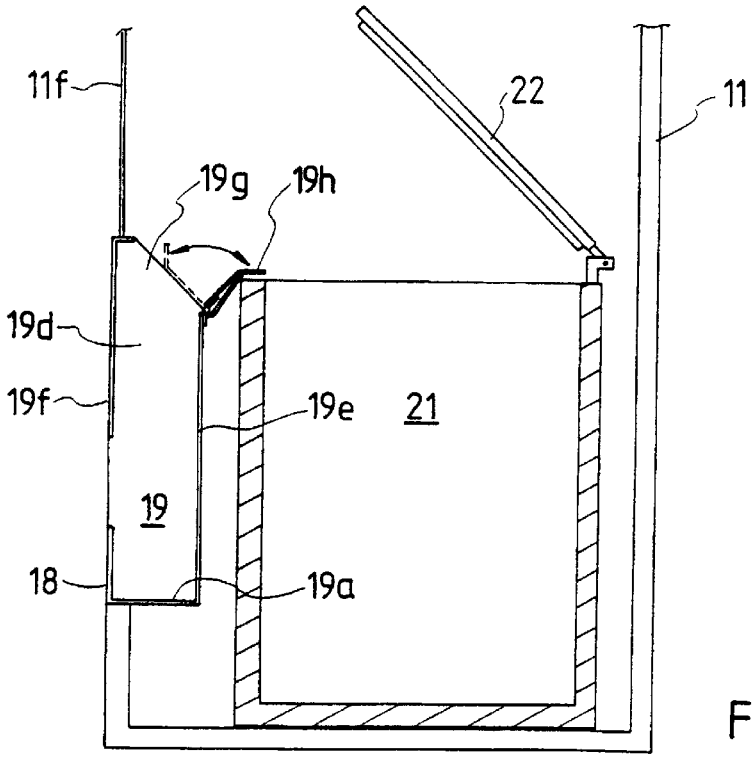
FIG. 15 is a partial side elevation of the vending machine of FIG. 1 showing the operation of the guide assembly illustrated in FIG. 14.

The extraction tube 35 in this embodiment is a coil spring which is operatively connected at one end to an actuator 48 within the stand 24 by a crank assembly 45 and passes through a passage 46 provided in the shaft 26, beside the two arm members 28 and 32 and through the passage 34 in the guide head 33 to terminate in a free end 35*b* which moves up and down into and out of the freezer compartment under the action of the actuator 48. The path of movement of the spring beside each of the arm members is guided by tubular guide members 49 and 51 connected to the first and second arm members respectively. The path of movement of the spring within the frame assembly below the shaft 26 is guided by a plurality of spaced apart guide roller assemblies 52 each having three guide rollers 53 and the crank arm 47 is arranged to move through a maximum arc of approximately 90 degrees to move the free end of the extraction tube down and up from a position above the freezer compartment to a position near the bottom of the freezer compartment as required. The operation of the extraction tube is more clearly shown in FIG. 11 and an alternative arrangement is shown in FIG. 12. In these drawings it can be seen that the crank assembly has a shaft which is mounted for pivotable movement about a horizontal axis extending across the vending machine from side to side and that the actuator 48 is connected at one end to the frame assembly and at the other end to a first crank arm 54 extending from the shaft and that the other crank arm 47 extends from the other end of the shaft and is much longer to give the required arc of movement. The alternative arrangement for guiding the extraction tube illustrated in FIG. 13 includes a sleeve member 71 suitably curved at the same radius as the arc of movement of the extraction tube. The sleeve member has a slot 72 extending from one end of the sleeve to the other and adapted to receive therethrough the end portion of the crank arm 47 for moving the extraction tube within the sleeve. The sleeve is mounted to the stand 24 by brackets 73 only one of which is shown.

Figure 6:
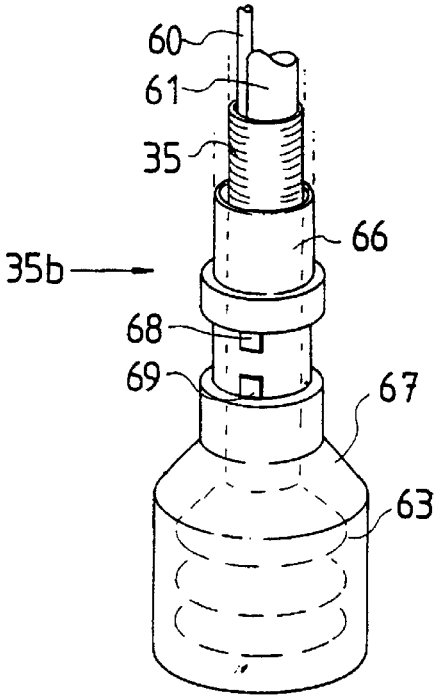
Figure 7:
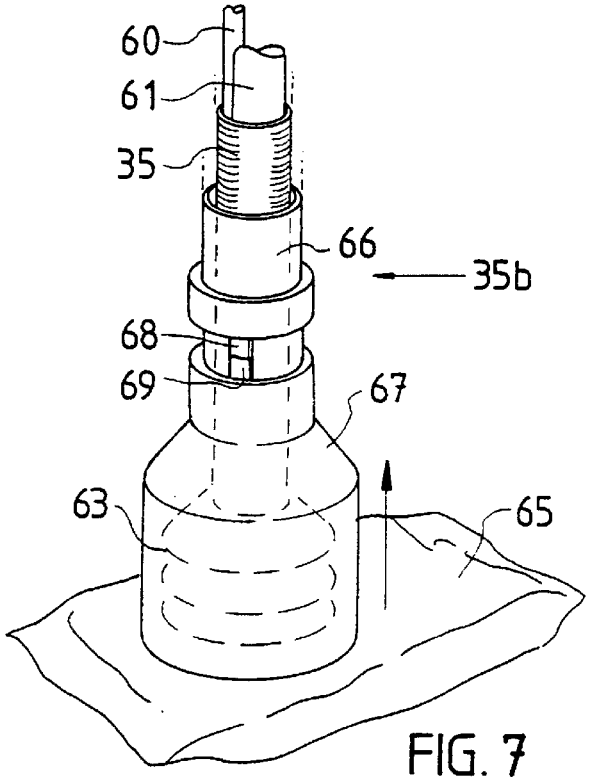
Figure 8:
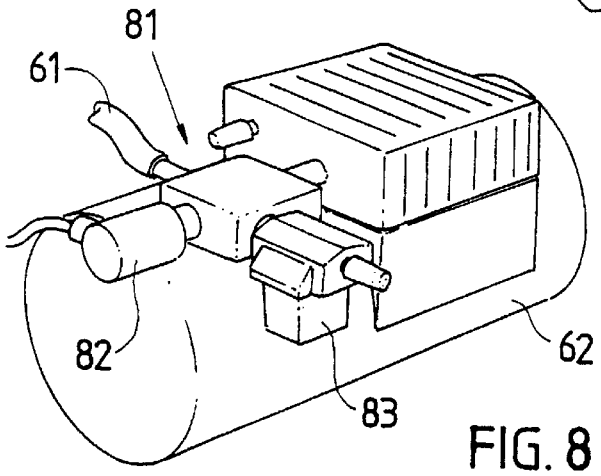
FIG. 8 is a pictorial representation of the vacuum pump of the vending machine of FIG. 1.
Figure 9:
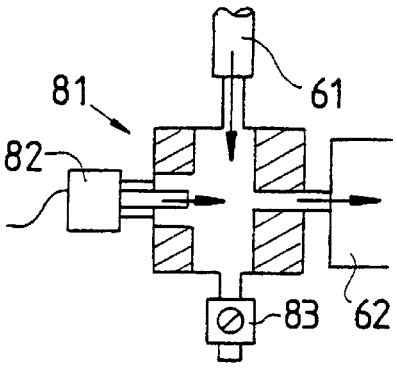
FIGS. 9 and 10 are schematic representations of the vacuum control valve assembly of the vending machine of FIG. 1.
Figure 10:
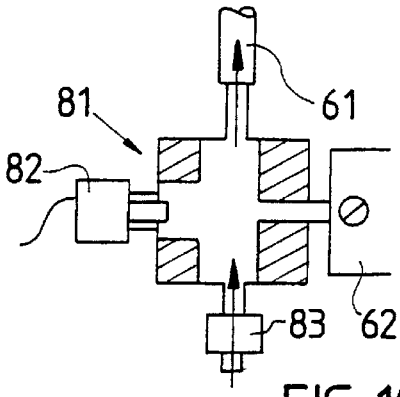

A vacuum tube 61 extends fully through the extraction tube 35 and is connected at one end to a vacuum pump 62 mounted to the frame assembly and at its other end to a bellows type rubber suction cup 63, the mouth of which is adapted to deform to the shape of the surface of the article to be extracted as vacuum is applied via the vacuum tube. A proximity switch 64 is attached to the extraction tube near its free end and electrically connected to the controller 15 by wire 60 for sensing the position of the free end or the suction cup relative to a product to be extracted and the controller is configured to switch the vacuum pump on in response to a signal from the proximity switch. In an alternative embodiment illustrated in FIGS. 6 and 7, a micro-switch is used instead of the proximity switch. In this arrangement, an inner sleeve 66 is fitted to the free end of the extraction tube and an outer sleeve 67 is slidably mounted on the inner sleeve, the outer sleeve forming a shroud about the suction cup 63 and being adapted to slide relative to the inner sleeve upon making contact with the product 65 to be extracted. A two part switch having a reed 68 mounted on the inner sleeve and axially spaced from the outer sleeve and a complementary magnet 69 mounted on the outer sleeve. Movement of the outer sleeve relative to the inner sleeve by a predetermined distance causes the reed and the magnet to engage, thus causing the controller to switch the vacuum pump on.

The opening and closing of the lid 22 is effected by a fifth linear actuator 56 which is connected at one end to the wall of the freezer and at the other end to the lid via a link member 55, the actuator also being controlled by the electronic controller.

The delivery chute 19 has a base wall 19*a* forming the base of the delivery station 18, two spaced apart side walls 19*c* and 19*d*, a rear wall 19*e* adjacent the freezer and a front wall panel 19*f* adjacent the cabinet front wall 11*f*. The chute has a product entry 19*g* at its upper end for receiving products from the extraction unit. It will be appreciated that the overall width of the vending machine, front to rear must be limited to allow passage through doorways and the like and accordingly the size of the chest freezer which can be accommodated in the cabinet is limited and so to the width of the delivery chute. The chute in this case includes a door or flap 19*h* at its upper end which opens in response to opening of the freezer lid 22 towards the freezer compartment. Advantageously, the door acts as a guide for products being dropped into the chute by the product extraction unit thus allowing the width of the chute to be minimised and the freezer width to be maximised. opening of the door 19*h* is effected by a bowden cable 19*j* which is connected at one end to the door by a crank assembly 19*k* and to the freezer lid at the other end.

In use, a customer selects a desired product by pressing a button on the control panel 13 whereupon an electronic signal causes actuator 56 to open the lid of the freezer so that the desired product can be extracted by the product extraction unit. As the lid opens the chute door 19*h* opens to provide a product guide and once the freezer lid is open the product extraction unit moves to a position wherein the guide head is directly above the compartment containing the desired product (as indicated in phantom in FIG. 5) whereupon the actuator 48 causes the spring and the vacuum tube sheathed thereby with the attached suction head to move downwardly towards the desired product. Upon the suction head reaching a position of close proximity to the product, the suction head "sucks on" to the product and downward movement of the extraction tube is stopped in response to transmission of a signal from the proximity switch 64 and subsequently the actuator 48 retracts the extraction tube and the product attached to the suction head to a position above the freezer. Once the product is above the freezer as indicated by the position of the actuator 48 (by a signal pulse transmitted to the controller) the product extraction unit pivots about axis 27 and moves to a position above the chute 19 where it releases the product thereinto. The product extraction unit then moves to the fully retracted disposition illustrated in FIG. 5 and the lid is closed by actuator 56 ready for the next customer. In order to inhibit accidental early release of a product from the suction cup due to twitching of the proximity switch, the vacuum tube is connected to the vacuum pump via a valve assembly 81. The valve assembly includes a vacuum activated switch 82 which closes upon start-up of the vacuum pump to complete an auxiliary power supply circuit to the pump, and a vacuum release valve 83 adapted to release the vacuum from the vacuum tube 61 upon the product extraction unit reaching a predetermined delivery position so that the product can be released.

It will of course be realised that while the foregoing description has been given by way of illustrative example of the invention all such and other modifications and variations thereto as would be apparent to persons skilled in the art are deemed to fall within the broad scope and ambit of this invention as defined in the appended claims.

What is claimed is:

1. A vending machine including:

a cabinet;

a storage compartment in said cabinet for storing products to be vended, said storage compartment having an upwardly directed access opening;

product extraction means in said cabinet for extracting products from said storage compartment and a customer accessible product station for receiving products extracted by said product extraction means;

selection means on a customer accessible position of said cabinet for selecting a product to be extracted;

control means in operative communication with said product extraction means for controlling the operation of said product extraction means in response to a product selection; and said product extraction means including a base member operatively connected to said cabinet or mounted in said cabinet for pivoting movement relative thereto about a vertical axis and first elongate link means operatively connected at one end to said base member for pivoting movement relative thereto about a first horizontal axis and second elongate link means operatively connected at one end to the other end of said first elongate link means for movement relative to said first elongate link means about a second horizontal axis, first actuation means operatively connected to said first elongate link means and said base member for pivotally moving said first elongate link means about said first horizontal axis, second actuation means operatively connected to said first and second elongate link means for pivotally moving said second elongate link means relative to said first elongate link means above said access opening about said second horizontal axis, third actuation means operatively connected to said base member for pivotally moving said base member about said vertical axis, and coupling means operatively connected to the other end of said second elongate link means for coupling with a selected product wherein it may be extracted from said storage compartment.

2. A vending machine according to claim 1, wherein said product extraction means is mounted on a stand in said cabinet and said third actuation means is operatively connected to said stand and said base member.

3. A vending machine according to claim 2, including fourth actuation means operatively connected to said coupling means for moving said coupling means up and down with respect to said second link means so that said coupling means may couple with products located at any depth within the storage compartment.

4. A vending machine according to claim 1. wherein said coupling means includes a flexible and resilient coupling head adapted to abut a surface of the selected product in such manner that vacuum pressure provided at said coupling head may cause the product to be sucked into secure engagement with said coupling head.

5. A vending machine according to claim 4, including a vacuum pump operatively connected to said coupling head by a tubular member.

6. A vending machine according to claim 5, wherein said vacuum pump has a low flow rate and provides a relatively high negative pressure vacuum, for example, 6 cubic metres per hour at −80 kPa.

7. A vending machine according to claim 5, wherein said tubular member is supported by a semi-rigid sheath which connects said coupling means to said fourth actuation means.

8. A vending machine according to claim 7, wherein said sheath is a helical spring which is guided for linear movement along or beside said first and second link means by respective guide means mounted to said first and second link means.

9. A vending machine according to claim 8, wherein said fourth actuation means is a short stroke linear actuator connected to said spring via a crank and said crank is mounted for pivoting movement relative to said cabinet.

10. A vending machine according to claim 5, wherein said control means includes sensing means for sensing the position of said coupling head relative to a product to be extracted.

11. A vending machine according to claim 10, wherein said sensing means includes a proximity switch mounted on or adjacent said coupling head for sensing the position of said coupling head relative to a selected product.

12. A vending machine according to claim 10, wherein said sensing means includes a contact member operatively connected to said coupling means and adapted for progressive displacement upon contact with the product to be extracted and a micro-switch arranged to sense a predetermined amount of displacement of said contact member.

13. A vending machine according to claim 10, wherein said sensing means is arranged to switch said vacuum pump on upon said coupling head reaching a predetermined position relative to the product to be extracted.

14. A vending machine according to claim 1, wherein said control means is arranged to control said first and second actuators for movement in unison so that the height of said distal second end relative to said access opening is maintained substantially constant.

15. A vending machine including:

a cabinet;

a refrigerated storage compartment in said cabinet for storing chilled or frozen food products, said storage compartment having an upwardly directed access opening and a compartment closure for closing said upwardly directed access opening;

product extraction means in said cabinet for extracting chilled or frozen food products from said storage compartment and a customer accessible product station for receiving products extracted by said product extraction means;

opening means operatively connected to said compartment closure for selectively opening said closure to allow said product extraction means access to food products in said refrigerated storage compartment;

selection means on a customer accessible position of said cabinet for selecting a product to be extracted;

control means in operative communication with said product extraction means for controlling the operation of said product extraction means and said opening means in response to a product selection; and said product extraction means including a base member operatively connected to said cabinet or mounted in said cabinet for pivoting movement relative thereto about a vertical axis and first elongate link means operatively connected at one end to said base member for pivoting movement relative thereto about a first horizontal axis and second elongate link means operatively connected at one end to the other end of said first elongate link means for movement relative to said first elongate link means about a second horizontal axis, first actuation means operatively connected to said first elongate link means and said base member for pivotally moving said first elongate link means about said first horizontal axis, second actuation means operatively connected to said first and second elongate link means for pivotally moving said second elongate link means relative to said first elongate link means above said access opening about said second horizontal axis, third actuation means operatively connected to said base member for pivotally moving said base member about said vertical axis, and coupling means operatively connected to the other end of said second elongate link means for coupling with a selected food product wherein it may be extracted from said storage compartment.

16. A vending machine according to claim 15, wherein said compartment closure is a lid mounted for up and down pivoting movement about a horizontal axis and said opening means is adapted to raise and lower said lid.

17. A vending machine according to claim 15, wherein said coupling means includes a flexible and resilient coupling head adapted to abut a surface of the selected product in such manner that vacuum pressure provided at said coupling head may cause the product to be sucked into secure engagement with said coupling head.

18. A vending machine according to claim 17, including a vacuum pump operatively connected to said coupling head by a tubular member.

19. A vending machine according to claim 18, wherein said vacuum pump has a low flow rate and provides a relatively high negative pressure vacuum, for example, 6 cubic metres per hour at −80 kPa.

20. A vending machine according to claim 18, wherein said tubular member is supported by a semi-rigid sheath which connects said coupling means to said fourth actuation means.

21. A vending machine according to claim 20, wherein said sheath is a helical spring which is guided for linear movement along or beside said first and second link means by respective guide means mounted to said first and second link means.

22. A vending machine according to claim 21, wherein said fourth actuation means is a short stroke linear actuator connected to said spring via a crank and said crank is mounted for pivoting movement relative to said cabinet.

23. A vending machine according to claim 18, wherein said control means includes sensing means for sensing the position of said coupling head relative to a product to be extracted.

24. A vending machine according to claim 23, wherein said sensing means includes a proximity switch mounted on or adjacent said coupling head for sensing the position of said coupling head relative to a selected product.

25. A vending machine according to claim 23, wherein said sensing means includes a, contact member operatively connected to said coupling means and adapted for progressive displacement upon contact with the product to be extracted and a micro-switch arranged to sense a predetermined amount of displacement of said contact member.

26. A vending machine according to claim 23, wherein said sensing means is arranged to switch said vacuum pump on upon said coupling head reaching a predetermined position relative to the product to be extracted.

27. A vending machine according to claim 15, wherein said product extraction means is mounted on a stand in said cabinet and said third actuation means is operatively connected to said stand and said base member.

28. A vending machine according to claim 27, including fourth actuation means operatively connected to said coupling means for moving said coupling means up and down with respect to said second link means so that said coupling means may couple with products located atany depth within the storage compartment.

29. A vending machine. according to claim 15, wherein said control means is arranged to control said first and second actuators for movement in unison so that the height of said distal second end relative to said access opening is maintained substantially constant.

30. A vending machine including:

a cabinet;

a refrigerated storage compartment in said cabinet for storing chilled or frozen food products, said storage compartment having an upwardly directed access opening and a compartment closure for closing said upwardly directed access opening;

product extraction means in said cabinet for extracting chilled or frozen food products from said storage compartment and a customer accessible product station for receiving products extracted by said product extraction means;

opening means operatively connected to said compartment closure for selectively opening said closure to allow said product extraction means access to food products in said refrigerated storage compartment;

selection means on a customer accessible position of said cabinet for selecting a product to be extracted;

control means in operative communication with said product extraction means for controlling the operation of said product extraction means and said opening means in response to a product selection;

transfer means for receiving extracted food products from said product extraction means and transferring said products to said product station, said transfer means including a chute and guide means for guiding a product to be transferred into said chute, said guide means being movable in response to a product selection from a stowed position remote from said storage compartment to a guiding position adjacent said storage compartment upon opening of said compartment closure;

said product extraction means including a base member operatively connected to said cabinet or mounted in said cabinet for pivoting movement relative thereto about a vertical axis and first elongate link means operatively connected at one end to said base member for pivoting movement relative thereto about a first horizontal axis and second elongate link means operatively connected at one end to the other end of said first elongate link means for movement relative to said first elongate link means about a second horizontal axis, first actuation means operatively connected to said first elongate link means and said base member for pivotally moving said first elongate link means about said first horizontal axis, second actuation means operatively connected to said first and second elongate link means for pivotally moving said second elongate link means relative to said first elongate link means above said access opening about said second horizontal axis, third actuation means operatively connected to said base member for pivotally moving said base member about said vertical axis, and coupling means operatively connected to the other end of said second elongate link means for coupling with a selected food product wherein it may be extracted from said storage compartment and delivered to said transfer means.

* * * * *